United States Patent [19]

Domroski

[11] 4,050,694

[45] Sept. 27, 1977

[54] BATTING PRACTICE KIT

[76] Inventor: Raymond J. Domroski, 811 Spring St., Michigan City, Ind. 46350

[21] Appl. No.: 665,454

[22] Filed: Mar. 10, 1976

[51] Int. Cl.[2] ..... A63B 69/40

[52] U.S. Cl. ..... 273/26 E; 273/58 C; 273/95 A

[58] Field of Search ..... 273/26 E, 29 A, 95 A, 273/58 C, 200 R, 200 A, 200 B, 197 R, 197 A, 184 B, 185 P, 185 C, 183 A, 195 R, 1.5 R

[56] References Cited

U.S. PATENT DOCUMENTS

| | | | |
|---|---|---|---|
| 2,199,461 | 5/1940 | Jones | 273/95 A |
| 2,219,732 | 10/1940 | Armstrong | 273/26 E |
| 3,006,647 | 10/1961 | Haskett | 273/200 R |
| 3,301,556 | 1/1967 | Hamilton, Jr. et al. | 273/26 E |
| 3,348,847 | 10/1967 | Fischl | 273/195 R |
| 3,375,010 | 3/1968 | Panza | 273/186 C |
| 3,601,398 | 8/1971 | Brochman | 273/26 E |
| 3;841,631 | 10/1974 | Dolan | 273/1.5 R |
| 3,858,881 | 1/1975 | Hurwitz | 273/29 A |
| 3,877,697 | 4/1975 | Lersch | 273/26 R |
| 3,948,517 | 4/1976 | Feiler | 273/26 E |

*Primary Examiner*—Richard C. Pinkham
*Assistant Examiner*—T. Brown

[57] ABSTRACT

A baseball batting practice kit containing a flexible ball tether swivelably suspended from a horizontal arm whose height is adjustable upon a vertical stand enables solitary batting practice by children who stand in correct relationship to the ball using a practice mat simulating a playing field surface including the shape of a home-plate.

1 Claim, 4 Drawing Figures

BATTING PRACTICE KIT

BACKGROUND OF THE INVENTION

The prior art is rich in tethered batting practice devices enabling solitary practice for baseball, tennis and other ball games. These devices fall generally into those in which the ball describes a vertical path and those in which it describes a horizontal path after being hit. Both types have typically required either a substantial indicated supporting structure as in U.S. Pat. No. 3,885,790 by Parr; or in U.S. Pat. No. 3,547,437 by Anderson; or the presence of a substantial existing supporting structure; such as a backyard swing set, as in U.S. Pat. No. 3,830,494 by Biskup; or a building, as in U.S. Pat. No. 3,716,235 by Yerkie, Jr. The prior art lacks a simple, lightweight batting practice device in kit form which can be readily assembled and used by a child. In addition the prior art fails to disclose a batting practice kit which includes a simulated playing surface.

SUMMARY OF THE INVENTION

The present invention discloses a batting practice kit containing all of the materials necessary to set up a simulated "home-plate" on any horizontal indoor or outdoor surface. A lightweight hollow base is given adequate mass to support the batting practice device by filling with granular or liquid filler, such as sand or water. A vertical column extending upward from the weighted base provides support for a horizontal arm which is attachable to the vertical column at any height, thereby enabling use by players of varying stature. A flexible ball-support tether is swivelably attached to the outboard end of the horizontal arm. A ball, attached to the lower end of the flexible ball-support tether, is suspended at a selectable convenient height above the playing surface and in selectable lateral relationship with the simulated "home-plate".

DETAILED DESCRIPTION OF THE PREFERRED EMBODIMENT

Figure 1:
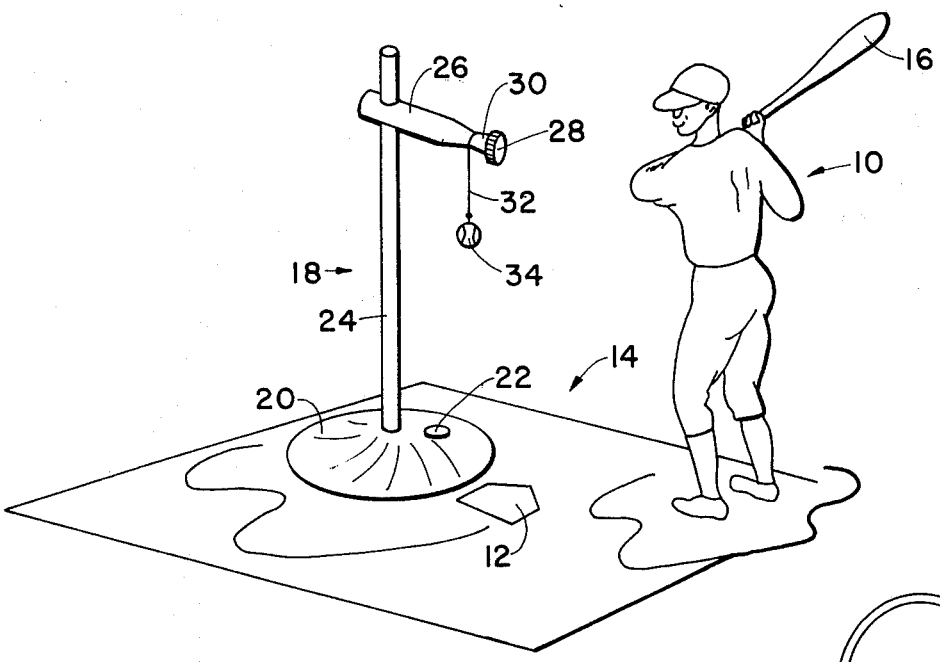
FIG. 1 shows the batting practice kit assembled and in use.

The following description is written with reference to FIG. 1. The player, indicated generally at 10, is shown standing in the normal relationship to simulated home plate 12 which is an element of a practice mat shown generally at 14. The player 10 is shown holding a bat 16, preferably made of plastic material, also supplied as part of the kit, shown generally at 18, stands on the practice mat 14 on the opposite side of the home plate 12 from the player 10. The batting practice device 18 consists of a hollow base 20 having a filler hole 22 through which stabilizing filler material, such as sand or water, may be injected. The hollow base 20 rests upon the practice mat 14. A vertical column 24 projects upward from the hollow base 20. A horizontal support arm 26 is attached to the vertical column 24. The horizontal support arm 26 extends outward to a terminating knob 28. A reduced-diameter neck region 30 inboard of the terminating knob 28 provides an attachment area for a ball tether 32. A ball 34 is suspended at the end of the ball tether 32 in a position convenient for hitting by the player 10.

Figure 2:
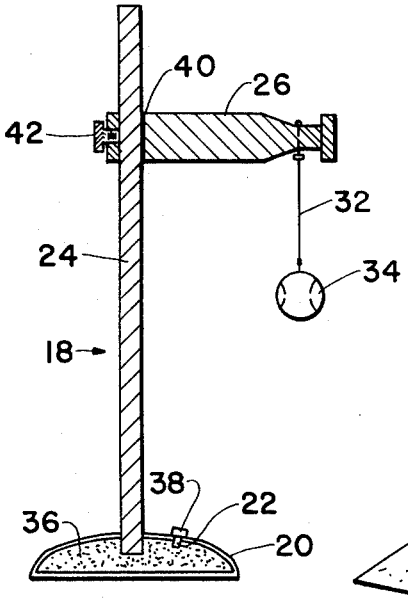
FIG. 2 shows a cross-sectional view of the batting practice device.

Further details of the batting practice device 18 are described with reference to FIG. 2. A hollow region 36 is shown in the interior of the base 20. The hollow region 36 is filled with weighting material such as sand or water through the filler hole 22. A stopper 38 closes the filler hole 22 to retain the weighting material in the base 20.

A supporting notch 40 in the inboard end of the horizontal arm 26 at least partially encircles the vertical column 24. The fit between the supporting notch 40 and the vertical column 24 is slideably loose in order to enable adjustment of the horizontal arm 26 to any convenient height. A locking screw 42, tightenable to bear frictionally on the vertical column 24, locks the horizontal arm 26 in the selected position.

Figure 3:
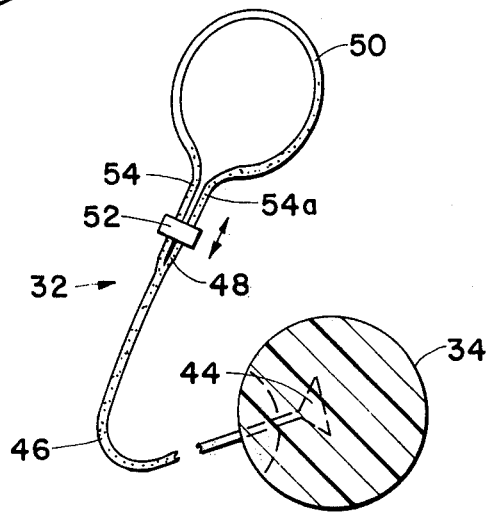
FIG. 3 shows a detailed view of the manner of tethering the ball.

Reference is now had to FIG. 3 and preceeding figures in the following description. The ball tether, shown generally at 32, provides the means for suspending the ball 34 from the neck region 30 of the horizontal arm. An enlarged attachment member 44, formed on the inside of the hollow ball 34, attaches the flexible support cord 46 to the ball 34. At its upper end, the support cord 46 becomes bifurcated 48, thereafter forms a loop 50. A clip 52, frictionably slideable upon the two legs **54, 54*a* of the loop 50 provides means for adjusting the circumference of the loop 50 larger or smaller. To attach the tether 32 to the horizontal arm 26, the circumference of the loop 50 is made large enough by sliding the clip 52 downward that the loop 50 will fit over the terminating knob 28, the loop 50 is slipped over the terminating knob 28, then the circumference of the loop 50 is sufficiently reduced by sliding the clip upward that the loop 50 can no longer slip over the terminating knob 28.**

Figure 4:
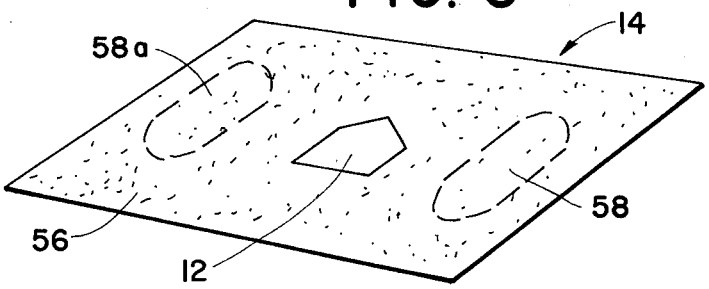
FIG. 4 shows a detailed view of the practice mat.

Reference is now made to FIG. 4 for the detailed description of the practice mat 14 which follows. The practice mat 14 has a surface 56 which more or less simulates the color and texture of the natural playing surface. The typical shape of a home plate 12, namely a square with a triangle appended to one side, is marked in contrasting color and/or texture on the practice mat 14. Batter's boxes for right-handed batters 58 and for left-handed batters **58*a* are marked on the playing surface 56 to designate the areas where the player 10 is to stand. The base 20 of the batting practice device 18 is placed in the batter's box 58, 58*a* opposite to the one occupied by the player 10. For example, the right-handed player 10 shown would occupy the right-handed batter's box 58 while the base 20 of the batting practice device 18 would occupy the left-handed batter's box 58*a*.**

It is to be understood that the scope of the invention is not limited to the exact embodiment disclosed in the preceeding, which is merely descriptive, but instead it covers all reasonable equivalents thereto.

What is claimed is:

1. A baseball batting practice kit for use by a batter comprising:

a. a simulated playing surface;

b. said simulated playing surface having a simulated baseball home plate generally centrally located thereon;

c. said simulated surface further having at least two batter's boxes thereon spaced on opposite sides of said simulated baseball home plate;

d. a hollow base adapted to containing stablizing filler material;

e. said hollow base having a substantially flat bottom and said flat bottom being adapted to being placed upon one of said batter's boxes;

f. a substantially vertical column supported by and projecting upward from said hollow base;

g. a substantially horizontal arm having one of its ends cooperatively engaging said vertical column and adapted to being displaced into a plurality of vertical positions thereon;

h. means for locking said horizontal arm in one of said vertical positions;

i. a reduced-diameter neck region on said horizontal arm adjacent to its other end thereof;

j. a hollow ball;

k. a tether attached to said hollow ball at one end and having a loop at its other end;

l. said loop being adapted to passing over said other end of said horizontal arm whereby said hollow ball hangs suspended therefrom;

m. a clip on said tether adapted to reducing the dimension of said loop whereby said loop is freely retained in said reduced-diameter neck region and said tether and ball are enabled to rotate about the longitudinal axis of said arm; and n. said horizontal arm being cooperative with said simulated playing surface whereby said ball is suspended over said home plate when said hollow base is positioned on the batter's box opposite the batter's box occupied by said batter.

* * * * *